US007616915B2

(12) United States Patent
Shimojima et al.

(10) Patent No.: US 7,616,915 B2
(45) Date of Patent: Nov. 10, 2009

(54) IMAGE FORMING APPARATUS HAVING A FORCE-CONVERTING MECHANISM TO DETACH A ROTARY BODY

(75) Inventors: Kazuhiro Shimojima, Ibaraki (JP); Yoshitaka Fujinuma, Ibaraki (JP); Susumu Tateyama, Ibaraki (JP); Yukinori Sakuma, Ibaraki (JP)

(73) Assignee: Ricoh Company Ltd., Tokyo (JP)

( * ) Notice: Subject to any disclaimer, the term of this patent is extended or adjusted under 35 U.S.C. 154(b) by 160 days.

(21) Appl. No.: 11/867,410

(22) Filed: Oct. 4, 2007

(65) Prior Publication Data

US 2008/0101818 A1 May 1, 2008

(30) Foreign Application Priority Data

Nov. 1, 2006 (JP) ..... 2006-298246

(51) Int. Cl.
*G03G 15/00* (2006.01)
*G03G 21/00* (2006.01)

(52) U.S. Cl. ..... 399/117; 399/110

(58) Field of Classification Search ..... 399/117, 399/116, 110, 159

See application file for complete search history.

(56) References Cited

U.S. PATENT DOCUMENTS

2007/0253729 A1* 11/2007 Takagi ..... 399/117
2008/0247786 A1 10/2008 Nakayama et al.
2009/0097878 A1 4/2009 Kubo et al.
2009/0103954 A1 4/2009 Nakayama et al.

FOREIGN PATENT DOCUMENTS

| | | | |
|---|---|---|---|
| JP | 01-088481 A | * | 4/1989 |
| JP | 4-9075 | | 1/1992 |
| JP | 5-289588 | | 11/1993 |
| JP | 10-104996 | | 4/1998 |
| JP | 10-254327 | | 9/1998 |
| JP | 2005-107413 | | 4/2005 |
| JP | 2005-212165 | | 8/2005 |

* cited by examiner

*Primary Examiner*—Sophia S Chen
(74) *Attorney, Agent, or Firm*—Oblon, Spivak, McClelland, Maier & Neustadt, L.L.P.

(57) ABSTRACT

A bearing detachably and rotatably holds a photoconductor. A bearing holder firmly holds the bearing. A rotating lever is provided on a rotation axis of a photoconductor between the photoconductor and the bearing holder. The bearing holder and the rotating lever are provided with many protrusions at regular intervals. At a first relative position of the bearing holder and the rotating lever, the protrusions on the bearing holder are located in between the protrusions on the rotating lever. At a second relative position of the bearing holder and the rotating lever, the protrusions on the bearing holder ride on the protrusions on the rotating lever thereby pushing the photoconductor away from the bearing and detaching the photoconductor from the bearing.

12 Claims, 6 Drawing Sheets

IMAGE FORMING APPARATUS HAVING A FORCE-CONVERTING MECHANISM TO DETACH A ROTARY BODY

CROSS-REFERENCE TO RELATED APPLICATIONS

The present application claims priority to and incorporates by reference the entire contents of Japanese priority document, 2006-298246 filed in Japan on Nov. 1, 2006.

BACKGROUND OF THE INVENTION

1. Field of the Invention

The present invention relates to a rotary body in an image forming apparatus.

2. Description of the Related Art

Image forming apparatuses includes various rotary bodies. Photoconductors or feeding rollers are example of such a rotary body. Such rotary bodies are often removed from the image forming apparatus for the purpose of replacement or maintenance.

In the explanation given bellow, a photoconductor is used as an example of the rotary bodies.

Both ends of a rotating shaft of the photoconductor are supported by photoconductor-supporting panels provided on the image forming apparatus. In the image forming apparatus disclosed in Japanese Patent Application Laid-Open No. H10-254327, the photoconductor is housed in a photoconductor unit, and the photoconductor-supporting panels are formed on internal walls of the photoconductor unit near the ends of the rotating shaft of the photoconductor. Each photoconductor-supporting panel of the photoconductor unit includes a bearing. The bearing, i.e., an engaged member on the image forming apparatus side, is engaged with the rotating shaft of the photoconductor, i.e., the engaging member on the photoconductor side. The photoconductor is supported by the photoconductor unit arranged in the image forming apparatus, by engaging the rotating shaft of the photoconductor to the bearings of the photoconductor unit.

How the conventional photoconductor is removed from the photoconductor unit is explained below with reference to FIGS. 6A and 6B.

FIG. 6A is a schematic diagram of a conventional photoconductor unit 2000 in a state attached to a main frame 3 of an image forming apparatus. FIG. 6B is a schematic diagram of the photoconductor unit 2000 in a state removed from the main frame 3. An arrow F indicates the front side, and an arrow R indicates the rear side of the image forming apparatus. The photoconductor unit 2000 can be removed from the main frame 3 by pulling it toward the front side.

When the photoconductor unit 2000 is in a state attached to the main frame 3 as shown in FIG. 6A, a front bearing-holder 6 is in a state attached to a front panel 2*b* of the photoconductor unit 2000. A front bearing 7 is held in the front bearing-holder 6, and engages with a front-end projection 1*e*, i.e., the front-side end of the rotating shaft of the photoconductor 1. On the other hand, a rear bearing-holder 4 is in a state attached to a rear panel 2*a* of the photoconductor unit 2000. A rear bearing 5 is held in the rear bearing-holder 4, and engages with a rear-end projection 1*d*, i.e., the rear-side end of the rotating shaft of the photoconductor 1. In this manner, the photoconductor 1 is supported by the photoconductor unit 2000 by engaging both ends of the rotating shaft of the photoconductor 1 with the bearings 5 and 7 fixed on the photoconductor unit 2000.

The front bearing-holder 6 is removable from the front panel 2*b* of the photoconductor unit 2000 while the photoconductor unit 2000 is in a state attached to the main frame 3. To remove the photoconductor 1, an operator first removes the front bearing-holder 6, and then pulls out the photoconductor unit 2000 toward the front side (direction shown in the arrow F in the FIG. 6A). This results in the state shown in FIG. 6B. Thereafter, the operator slides the photoconductor 1 forward (toward the front side), disengaging the rear-end projection 1*d* from the rear bearing 5. Then, the operator lifts up and removes the photoconductor 1.

During the process of removing the photoconductor 1, if the operator mistakenly tilts the photoconductor 1 when sliding it out in an attempt to pull out the rear-end projection 1*d* from the rear bearing 5 for disengagement, the rear-end projection 1*d* also slides due to the tilting. If the rear-end projection 1*d* slides with respect to the rotation axis of the photoconductor 1, the rear-end projection 1*d* can get seized with the rear bearing 5, preventing the rear-end projection 1*d* of the photoconductor 1 from being removed from the rear bearing 5.

This problem is not limited to the photoconductors, but also occurs in the case of other rotary bodies. The same problem can occur in any structure that has a rotary body supported by a supporting member on the apparatus itself by engaging a part of the rotary body to the supporting member on the apparatus.

SUMMARY OF THE INVENTION

It is an object of the present invention to at least partially solve the problems in the conventional technology.

According to an aspect of the present invention, there is provided an image forming apparatus. The image forming apparatus includes a rotary body; a supporting member that detachably and rotatably supports a portion of the rotary body, the rotary body being detachable from the supporting member when moved in a detachment direction; a rotatable member that rotates around a rotation axis of the rotary body, rotation of the rotatable member being independent of rotation of the rotary body; and a force-converting mechanism that converts a rotation force generated by the rotation of the rotatable member into a force whereby the rotary body moves in the detachment direction thereby detaching from the supporting member.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are described in detail below with reference to the accompanying drawings.

Figure 1:
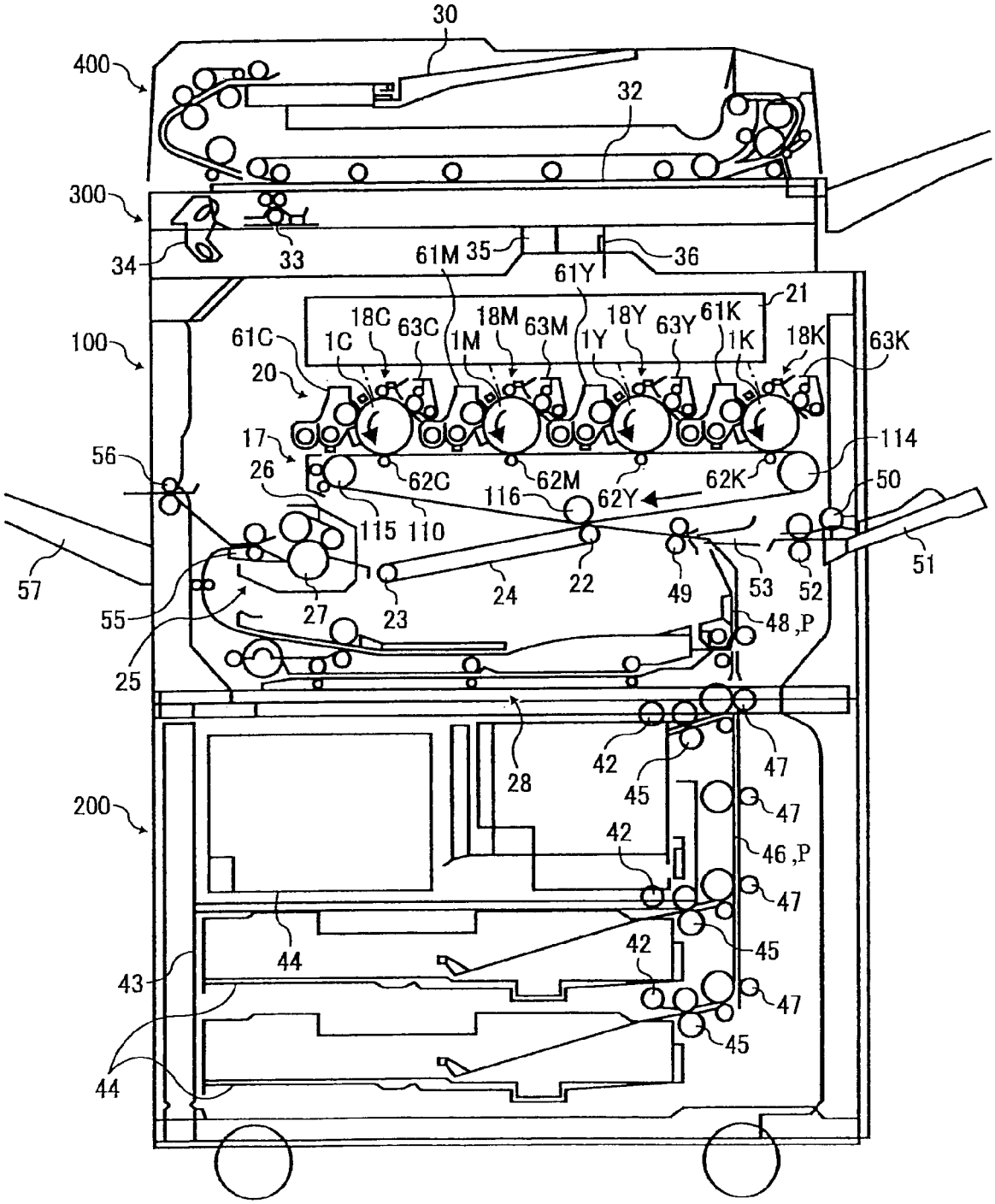
FIG. 1 is a schematic diagram of a copy machine according to an embodiment of the present invention.

FIG. 1 is a schematic diagram of a copy machine, which is an example of an image forming apparatus, according to an embodiment of the present invention. The copy machine includes a copying apparatus itself (hereinafter, "printing unit 100"), a paper feeding table (hereinafter, "paper feeding unit 200"), a scanner (hereinafter, "scanning unit 300") mounted on the printing unit 100, and an automatic document feeder (ADF) (hereinafter, "document feeding unit 400") mounted on the scanning unit 300. The copy machine also includes a control unit (not shown) that operates each unit in the copy machine.

In the middle of the printing unit 100, there is an intermediate transfer belt 110 that acts as an intermediate transfer member. The intermediate transfer belt 110 is supported by a first supporting roller 114, a second supporting roller 115, and a third supporting roller 116, and the surface of thereof rotates in the clockwise direction. Four photoconductors 1K, 1Y, 1M, and 1C are arranged facing to the intermediate transfer belt 110. Each of the photoconductors 1K, 1Y, 1M, and 1C acts as a latent-image carrier that carries a latent image for one of four colors, black, yellow, magenta, and cyan on its surface. Each of four developing units 61K, 61Y, 61M, and 61C develops the latent image to form a toner image on each surface of the four photoconductors 1K, 1Y, 1M and 1C. Four photoconductor cleaning units 63K, 63Y, 63M, 63C remove residual toner on the surface of photoconductors 1K, 1Y, 1M, and 1C after a primary transfer is performed. The four photoconductors 1K, 1Y, 1M, and 1C, the four developing units 61K, 61Y, 61M, and 61C, and the four photoconductor cleaning units 63K, 63Y, 63M, 63C form four image forming units 18K, 18Y, 18M and 18C, respectively. The four image forming units 18K, 18Y, 18M and 18C are arranged side by side to form a tandem-type image forming unit 20. A belt cleaning unit 17 is provided facing the second supporting roller 115 sandwiching the intermediate transfer belt 110. The belt cleaning unit 17 removes residual toner on the intermediate transfer belt 110 after the toner image is transferred onto a recording medium such as a transfer paper. The printing unit 100 also includes an exposing unit 21 located above the tandem-type image forming unit 20.

The printing unit 100 also includes primary transfer rollers 62K, 62Y, 62M, and 62C inside the rotating intermediate transfer belt 110, arranged to face to each of the photoconductor 1K, 1Y, 1M, and 1C across the intermediate transfer belt 110. The primary transfer rollers 62K, 62Y, 62M, and 62C are pressed against the photoconductors 1K, 1Y, 1M, and 1C via the intermediate transfer belt 110, to form a first transferring unit.

A secondary transferring unit is provided abutting on a lower side of the intermediate transfer belt 110, that is, the side opposite to an upper side where the tandem-type image forming unit 20 is arranged. The secondary transferring unit includes a secondary transfer belt 24 stretched across a secondary transfer roller 22 and a secondary transfer-belt stretching roller 23. In the secondary transferring unit, the secondary transfer belt 24 is pressed against the third supporting roller 116 via the intermediate transfer belt 110 by the secondary transfer roller 22, forming a secondary transfer nip between the secondary transfer belt 24 and the intermediate transfer belt 110, as a secondary transferring unit.

At the left side of the secondary transferring unit in FIG. 1, a fixing unit 25 is provided to fix the image that lies on the transfer paper. The fixing unit 25 includes a fixing belt 26, which is an endless belt, pressed against a pressing roller 27. The secondary transferring unit also functions to feed the transfer paper with images transferred at the secondary transfer nip to the fixing unit 25. The secondary transferring unit can be implemented as a transfer roller or non-contacting charger; however, such implementations might be difficult to provide a function to feed the transfer paper.

A transfer-paper reversing unit 28 is arranged below the secondary transferring unit and the fixing unit 25 in parallel to the tandem-type image forming unit 20. The transfer-paper reserving unit 28 reverses a transfer paper for duplex printing. After the images are fixed on one side of the transfer paper, a switching nail switches the course of the transfer paper toward the transfer-paper reversing unit 28. The transfer-paper reversing unit 28 reverses the transfer paper, and feeds the reversed transfer paper to the secondary transfer nip again to have toner images be transferred again, and the transfer paper is ejected onto a paper catch tray 57.

The scanning unit 300 reads image data of a document that is placed on a contact glass 32 using a reading sensor 36, and sends the read image data to the control unit.

The control unit (not shown) operates a lightening unit (not shown) such as lasers or light emitting diodes (LEDs) that is arranged in the exposing unit 21 of the printing unit 100, based on the image data received from the scanning unit 300 to irradiate the photoconductors 1K, 1Y, 1M, 1C with writing laser lights (not shown). By the irradiation, electrostatic latent images are formed on the surface of each photoconductor 1K, 1Y, 1M, 1C. The latent images are developed and the toner images are formed in the development process.

The paper feeding unit 200 includes paper feeding cassettes 44 arranged in multiple stacks in a paper bank 43, paper feed rollers 42, separation rollers 45, and conveyor rollers 47. The paper feed rollers 42 feeds out the transfer papers P from the paper feeding cassettes 44. The separation rollers 45 separate the transfer papers P, and sends each paper P to a paper feeding path 46. The conveyor rollers 47 convey the transfer paper P to a paper feeding path 48 in the printing unit 100.

In the copy machine, the transfer papers P can be fed not only from the paper feeding unit 200 but also from a manual paper-feeding unit including a manual paper-feeding tray 51, a paper feed roller 50, and separation rollers 52. A transfer paper stacked on the manual paper-feeding tray 51 is fed by the paper feed roller 50. The separation rollers 52 separate each of the transfer papers and sends to a manual paper-feeding path 53.

Registration rollers 49 feeds only one transfer paper P from either the paper feeding cassettes 44 or the manual paper-feeding tray 51 at one time, and sends it to the secondary transfer nip located between the intermediate transfer belt 110 and the secondary transferring unit.

To copy a color image using the copy machine, a document is placed on a document platen 30 of the document feeding unit 400, or placed on the contact glass 32 of the scanning unit 300 by opening the document feeding unit 400, and pressed by closing the document feeding unit 400.

When a start button (not shown) is pressed, a document placed on the document feeding unit 400, the document is carried onto the contact glass 32. If the document is placed directly on the contact glass 32, the step of carrying the document onto the contact glass 32 is omitted. After that, in the scanning unit 300 is driven to operate a first carrier 33 and a second carrier 34. A light source in the first carrier 33 emits a light, receives a light reflected by the document surface, and sends the received light to the second carrier 34. Upon receiving the light, the second carrier 34 reflects the light by a mirror to the reading sensor 36 via an imaging lens 35. With the above configuration, image data of the document is scanned.

Upon receiving the image data from the scanning unit 300, the control unit drives one of the four paper feed rollers to feed the transfer paper having a size appropriate for the image data, so that the latent image on the surface of the photoconductor is written onto the transfer paper using the laser lights, and a toner image is formed on the surface thereof through the development process, which will be explained later in this specification.

A driving motor (not shown) drives one of the first supporting roller 114, the second supporting roller 115, or the third supporting roller 116 to rotate with the paper feed roller. The remaining two rollers of the first supporting roller 114, the second supporting roller 115, or the third supporting roller 116 follow the rotation thereof, and circulate the intermediate transfer belt 110. By rotating the photoconductors 1K, 1Y, 1M and 1C of each image forming unit 18K, 18Y, 18M, 18C at the same time, a monochromatic image of black, yellow, magenta, or cyan is formed on each of the photoconductors 1K, 1Y, 1M, 1C. The monochromatic images are sequentially transferred on the intermediate transfer belt 110 and synthesized into a color image.

In the paper feeding unit 200, one of the paper feed rollers 42 is selected and rotated to take out the transfer papers P from one of the paper feeding cassettes 44. The transfer papers P are separated from each other by the separation rollers 45, and fed into the paper feeding path 46 one by one. The transfer paper P is guided by the conveyor rollers 47 into the paper feeding path 48 in the printing unit 100, that is, the copy machine itself, and stopped at the registration rollers 49. Alternatively, the transfer papers P can also be taken out from the manual paper feeding tray 51 by rotating the paper feed roller 50, separated from each other by the separation rollers 52, fed into the manual paper feeding path 53 one by one, and stopped at the registration rollers 49 in the same manner.

The registration rollers 49 are rotated in at the appropriate timing when the intermediate transfer belt 110 is rotated to carry the synthesized color image on the surface thereof, and send the transfer paper P into the secondary transferring nip, where the intermediate transfer belt 110 meets the secondary transfer roller 22. By way of electrical field generated to transfer the image, or contacting pressure at the nip, the color image is recorded on the transfer paper P through secondary transferring process.

The transfer paper P, on which the color image is transferred at the secondary transfer nip, is fed into the fixing unit 25 via the secondary transfer belt 24 in the secondary transferring unit. The fixing unit 25 applies pressure and heat to the transfer paper P using the pressing roller 27 and the fixing belt 26 to fix the color image on the transfer paper P. Subsequently, the transfer paper P is ejected by ejecting rollers 56, and the transfer papers P are stacked on the paper catch tray 57. After the color image is fixed, those transfer papers P that require images formation on both side thereof are switched by the switching nail 55, carried to the transfer-paper reversing unit 28, reversed therein, and guided to the secondary transfer nip again. The image is recorded on the rear side of the transfer paper P, and ejected to the paper catch tray 57 via the ejecting rollers 56.

After the color image is transferred to the transfer paper P at the secondary transfer nip, the surface of the intermediate transfer belt 110 is cleaned by the belt cleaning unit 17, removing the remaining toner on the surface thereof, and is prepared for a subsequent image forming process by the tandem-type image forming unit 20.

As shown in FIG. 1, there are many roller-like rotary bodies in the copy machine. In some image forming apparatus, a rotary body is supported by the image forming apparatus, engaged a part of the rotary body with a supporting member attached to the image forming apparatus. In such a structure, when the rotary body is pulled out in an attempt to disengage it from the supporting members on the image forming apparatus, the engaging member of the rotary body might get slid tiled with respect to the engaged member of the image forming apparatus, and get seized.

Figure 2:
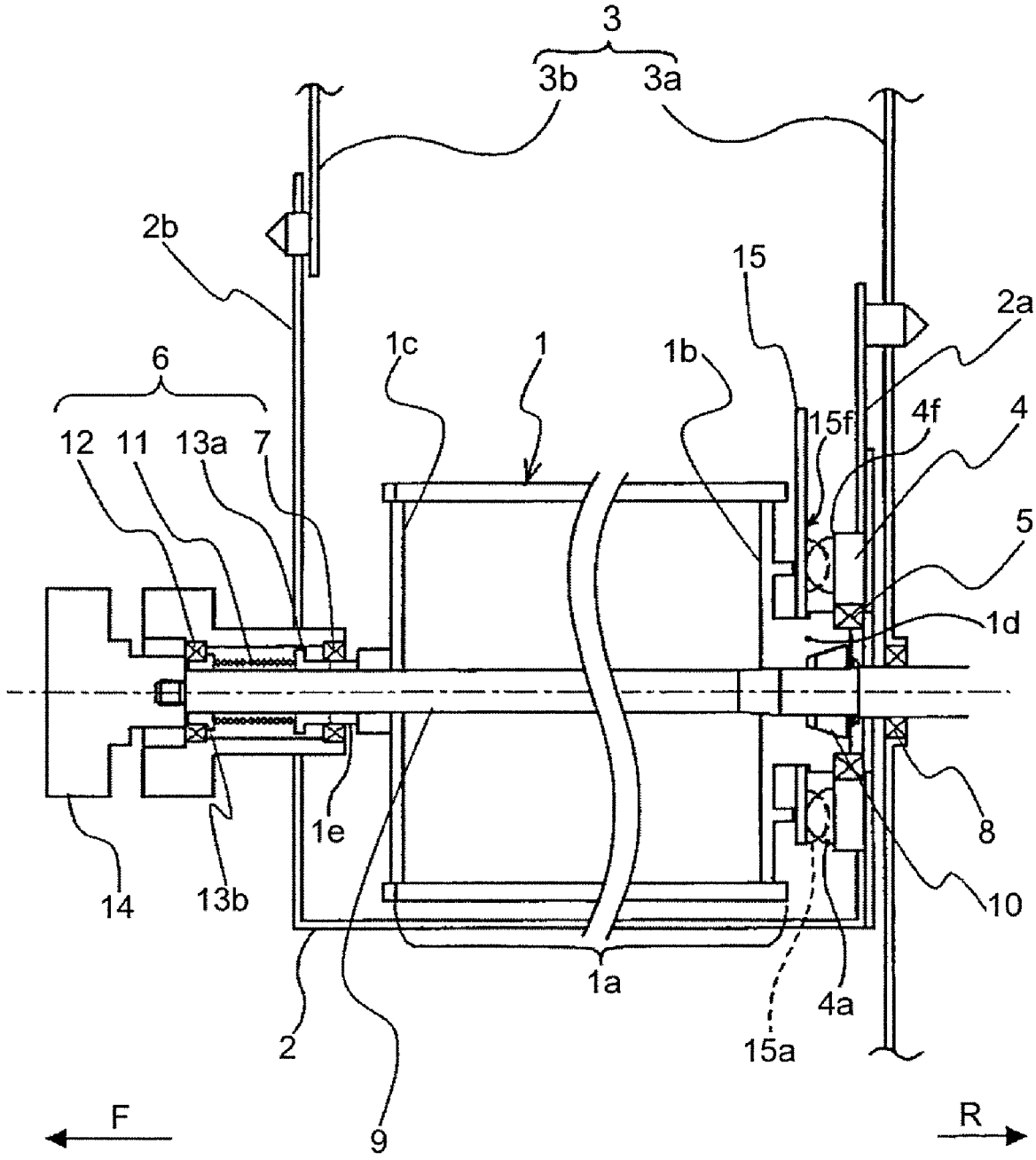
FIG. 2 is a schematic diagram of a photoconductor unit shown in FIG. 1.

FIG. 2 is a schematic diagram of a photoconductor unit 2. The photoconductor unit 2 is removable from the main frame 3 by being pulled out from the main frame 3, toward the front side of the copy machine (in a direction indicated by the arrow F in FIG. 2). The photoconductor unit 2 corresponds to any of the image forming units 18K, 18Y, 18M and 18C in FIG. 1. The image forming units such as the photoconductors 1K, 1Y, 1M, 1C (hereinafter generally referred to as "photoconductor 1"), the photoconductor cleaning units 63K, 63Y, 63M, 63C (hereinafter generally referred to as "photoconductor cleaning unit 63"), and the developing units 61K, 61Y, 61M, 61C (hereinafter generally referred to as "developing unit 61") are housed in a frame of the photoconductor units 2. Because the photoconductor unit 2 housed the image forming units, the photoconductor 1 or the photoconductor cleaning unit 63 is replaceable and maintenance of the developing unit 61 can be implemented easily by pulling out the photoconductor unit 2 from the copy machine. The photoconductor unit 2 can be a process cartridge that is removable from the copy machine. Although the photoconductor unit 2 is removable from the copy machine, the photoconductor unit 2 can be moved to a position slid out from the main frame not fully removed from the copy machine for the maintenance, for example, replacement of the photoconductor 1.

As shown in FIG. 2, the photoconductor 1 is housed in the photoconductor unit 2.

The photoconductor unit 2 is supported by the main frame 3, for example by way of the sliding rails (not shown), and can be slid in the thrust direction and pulled out from the main frame 3 toward the front side.

The following section explains how the photoconductor unit 2 is aligned with the photoconductor 1.

The photoconductor unit 2 is aligned with the main frame 3 by engaging pins, a round hole, and an elongated hole provided on a rear frame 3*a* and a front frame 3*b* of the main frame 3, and the rear panel 2*a* or the front panel 2*b* of the photoconductor unit 2.

Each of the pins and the holes can be provided on either side of the main frame 3, the rear frame 3*a* or the front frame 3*b*, or that of the photoconductor unit 2, the rear panel 2*a* or the front panel 2*b*. In the embodiment, the pin is provided on the front frame 3*b* of the main frame 3, and the hole is provided on the front panel 2*b* of the photoconductor unit 2 for the front side. The hole is provided on the rear frame 3*a* of the main frame 3, and the pin is provided on the rear panel 2*a* of the photoconductor unit 2 for the rear side. In this manner, the photoconductor unit 2 is aligned with the main frame 3.

On the rear side of the photoconductor unit 2, the rear bearing-holder 4 is fixed on the rear panel 2*a* of the photoconductor unit 2. The rear bearing 5, which is the supporting member on the image forming apparatus side, fits into the rear bearing-holder 4, which is an engaging member on a supporting member side. On the front side of the photoconductor unit 2, the front bearing-holder 6 is provided on the front panel 2*b* of the photoconductor unit 2. The front bearing-holder 6 is removable from the front panel 2*b* of the photoconductor unit 2. The front bearing 7 fits into the front bearing-holder 6.

The photoconductor 1 as a rotary body include a roller body 1*a* having a photoconductive layer. At each end of the photoconductor 1, a rear panel 1*b* and a front panel 1*c* are provided. Both ends of the roller body 1*a* in the axial direction thereof are formed into the rear-end projection 1*d* and the front-end projection 1*e*, respectively.

The rear-end projection 1*d*, which extends outwardly to the roller body 1*a* along the axis thereof and is located at the rear side of the photoconductor 1, is supported on the rear bearing 5. In other words, by the rear-end projection 1*d*, an engaging member of the rotary body, engaging to the rear bearing 5, the rear panel 2*a* of the photoconductor unit 2 acts as a supporting member on the image forming apparatus side to support the photoconductor 1, that is, a rotary body. With respect to the front side of the photoconductor unit 2, the front-end projection 1*e* is supported on the front bearing 7. The rear-end projection 1*d* is formed in integral with the rear panel 1*b*, and the front-end projection 1*e* is formed in integral with the front panel 1*c*. By the rear bearing 5 and the front bearing 7 supporting each end of the photoconductor 1, respectively, the photoconductor 1 is radially aligned with the photoconductor unit 2.

The rear side of a drum shaft 9 is supported on a rear shaft bearing 8 provided on the rear frame 3*a*, and kept immovable in the thrust direction by a stopper (not shown). A tapered, male-serrated coupling member 10 is fixed on the rear side of the drum shaft 9, and the rear-end projection 1*d* is provided with a tapered, female-serrated portion that interfaces with the coupling member 10.

By the coupling member 10 meeting the rear-end projection 1*d*, the drum shaft 9 is aligned with the photoconductor 1 in the thrust direction and the radial direction thereof. The drum shaft 9 rotates by a force from a rotation driving unit (not shown). The rotation force of the drum shaft 9 is transmitted to the photoconductor 1, thereby rotating the photoconductor 1.

Within the front bearing-holder 6 attached to the photoconductor unit 2, the front bearing 7 that supports the photoconductor 1, a compressed coil spring 11, and a front shaft bearing 12 are arranged. The front bearing-holder 6 further includes a pair of sliders, a rear slider 13*a* and a front slider 13*b*, that slides the photoconductor 1 in the thrust direction by using a force generated by the compressed coil spring 11.

When the front bearing-holder 6 is inserted to the front panel 2*b* of the photoconductor unit 2, the rear slider 13*a* meets the front-end projection 1*e*. By tightening the screws provided on the drum shaft 9 and a knob 14, the front bearing-holder 6, as well as the photoconductor 1, is displaced and pushed toward the rear side, and the rear-end projection 1*d* mounts on the coupling member 10. In this manner, the drum shaft 9 and the photoconductor 1 are aligned. At this time, the compressed coil spring 11 pushes the photoconductor 1 in the thrust direction.

When removing the photoconductor 1 from the photoconductor unit 2 in the structure above, the photoconductor 1 needs to be slid out along the rotation axis to disengage the rear-end projection 1*d* from the rear bearing 5. At this time, if the operator attempts to pull out the rear-end projection 1*d* of the photoconductor 1 from the rear bearing 5, in the same way as in a conventional structure, there the operator might end up causing the problem described below. That is, if the operator mistakenly slides out the photoconductor 1 tilted, in an attempt to pull it out, the rear-end projection 1*d* also becomes tilted and gets seized in the engaging area, preventing the rear-end projection 1*d* from being removed from the rear bearing 5.

If the rear bearing 5 and the rear-end projection 1*d* are engaged loosely so that the photoconductor 1 can be slid easily, the photoconductor 1 is rarely slid with a tilt, thus the engaging area may be prevented from being seized. However, if the photoconductor 1 are mounted in the image forming apparatus with loose engagement between the rear bearing 5 and the rear-end projection 1*d*, the axis of the photoconductor 1 might get shaken when rotated, causing images to be defective. Therefore, the engagement between the rear bearing 5 and the rear-end projection 1*d* must be tight. However, if the operator tries to slide the photoconductor 1 in the axis direction thereof with a hand, the photoconductor 1 can be slid tilted.

Furthermore, in the case that the rotary body is a photoconductor, another problem can be caused. When the operator slides out the photoconductor 1 along the rotation axis, holding each end panel thereof, there is a possibility that the operator can mistakenly touch the surface of the photoconductor. As a result, the photoconductor 1 get damaged or smudged with fingerprints, etc. If the photoconductor 1 is damaged or smudged with fingerprints, etc., the image quality degrades.

The following section explains salient features of the embodiment.

As shown in FIG. 2, the photoconductor 1 is provided with a rotating lever 15 between the rear-end projection 1*d* and the roller body 1*a*. The rotating lever 15 is a rotatable member that rotates around the rotation axis of the photoconductor 1. The rotating lever 15 is fixed to the rear-end projection 1*d* so that, if the rotating lever 15 is displaced to the front side as shown by the arrow F in FIG. 2, the rotating lever 15 mounts on the rear panel 1*b*. Therefore, if the rotating lever 15 is displaced to the front side from the position shown in FIG. 2, the photoconductor 1 is also displaced with the rotating lever 15.

An external surface 15*f* of the rotating lever 15 faces the same side as the rear-end projection 1*d*. An internal surface 4*f* of the rear bearing-holder 4 is located outer of the rear bearing 5, facing to the roller body 1*a*. The internal surface 4*f* faces to the external surface 15*f* of the rotating lever 15.

The external surface 15*f* of the rotating lever 15 and the internal surface 4*f* of the rear bearing-holder 4 are formed such that the rear-end projection 1*d* engages with the rear bearing 5 as shown in FIG. 2. In addition, a force generated by rotation of the rotating lever 15 is converted into a force that pushes the rotating lever 15 away from the rear bearing-holder 4, which is an apparatus-side facing member.

One example of structures, which is explained below, works to displace the rotating lever 15 away from the rear bearing-holder 4 by rotating the rotating lever 15, by way of the external surface 15*f* of the rotating lever 15 and the internal surface 4*f* of the rear bearing-holder 4 formed in a particular manner.

The external surface 15*f* of the rotating lever 15 has a plurality of protrusions 15*a*, which are the protrusions on the rotatable-member side. The internal surface 4*f* of the rear bearing-holder 4 also has a plurality of protrusions 4*a*, which are the protrusions on the apparatus side. The holder-side protrusions 4*a* are arranged on the internal surface 4*f* of the rear bearing-holder 4 so that the holder-side protrusions 4*a* meet the lever-side protrusions 15*a* when the rotating lever 15 is rotated. Furthermore, the lever-side protrusions 15*a* and the holder-side protrusions 4*a* are arranged so that at least a pair of the lever-side protrusion 15*a* and the holder-side protrusion 4*a* faces and touches each other when at least another pair of the lever-side protrusion 15*a* and the holder-side protrusion 4*a* faces and touches each other. In other words, multiple pairs of the lever-side protrusion 15*a* and the holder-side protrusion 4*a* face and touch each other simultaneously. According to the embodiment of the present invention, the areas of the lever-side external surface 15*f* and the holder-side internal surface 4*f* other those with protrusions area are planate.

As shown in FIG. 2, the internal surface 4*f* of the rear bearing-holder 4 holding the rear bearing 5 has protrusions 4*a* protruding toward the photoconductor 1. The external surface 15*f* of the rotating lever 15 attached to the photoconductor 1 has protrusions 15*a* protruding toward the rear bearing-holder 4.

The following section explains how the positions of the holder-side protrusions 4*a* and the lever-side protrusions 15*a* change when the rotating lever 15 is rotated.

Figure 3A:
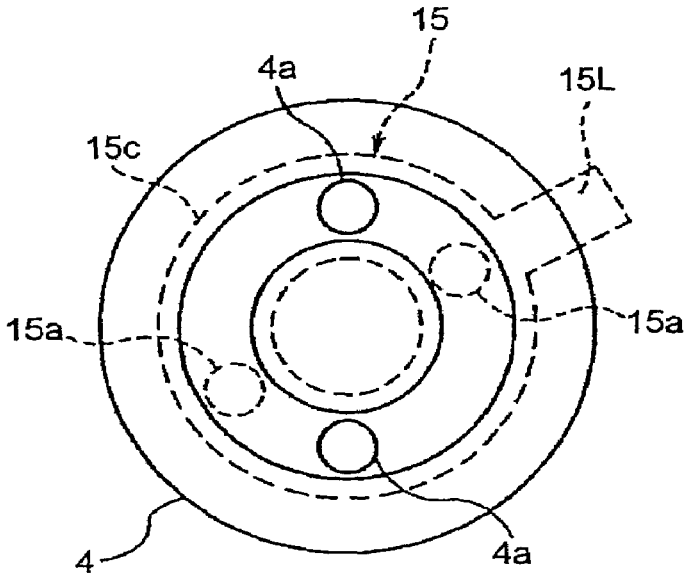
FIG. 3A is a top view of a rotating lever and a rear bearing-holder shown in FIG. 2 in an engaged state.
Figure 3B:
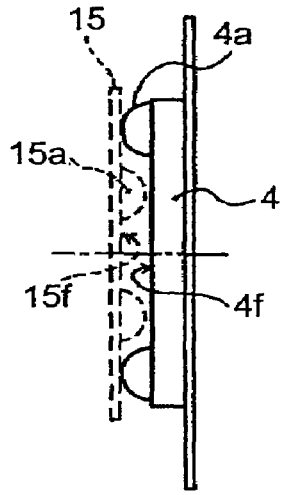
FIG. 3B is a side view of the rotating lever and the rear bearing-holder shown in FIG. 3A.
Figure 3C:
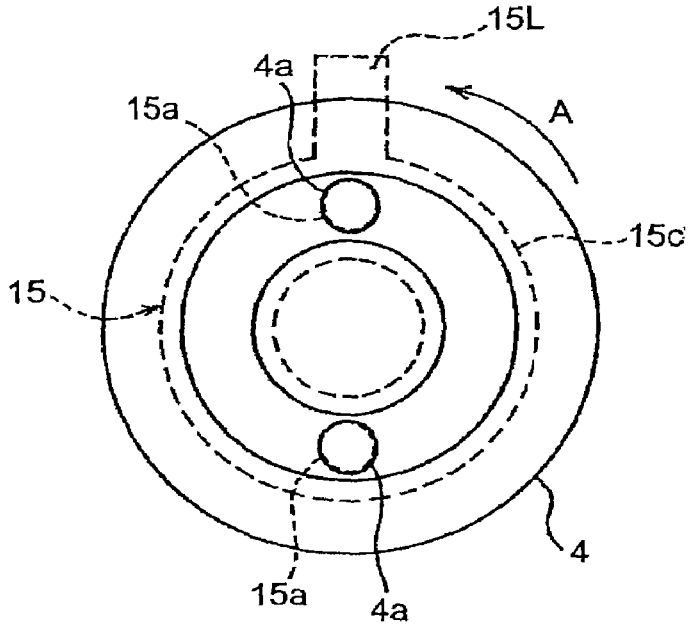
FIG. 3C is a top view of the rotating lever and the rear bearing-holder shown in FIG. 2 in a disengaged state.
Figure 3D:
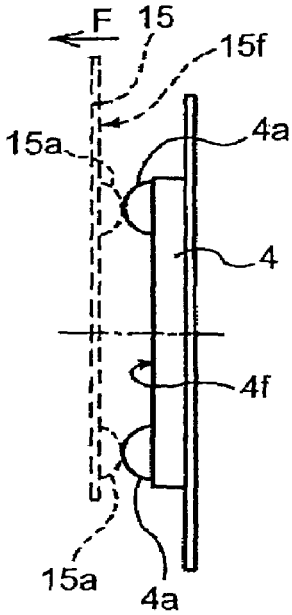
FIG. 3D is a side view of the rotating lever and the rear bearing-holder shown in FIG. 3C.

FIGS. 3A to 3D are diagrams for explaining how positions of the holder-side protrusions 4*a* and the lever-side protrusions 15*a* vary. FIGS. 3A and 3B are schematic diagram explaining the positions of the holder-side protrusions 4*a* and the lever-side protrusions 15*a* when the rear-end projection 1*d* engages with the rear bearing 5. FIGS. 3C and 3D are schematic diagrams explaining the positions of the holder-side protrusions 4*a* and the lever-side protrusions 15*a* when the rear-end projection 1*d* disengages from the rear bearing 5.

FIGS. 3A and 3C are top views of the holder-side protrusions 4*a* and the lever-side protrusions 15*a* viewing in the direction of the rotation axis of the photoconductor 1. FIGS. 3B and 3D are side views. Solid lines in FIGS. 3A to 3D indicate the shapes of the rear bearing-holder 4, and dotted lines indicate the shapes of the rotating lever 15.

As shown in FIGS. 3A to 3D, the rotating lever 15 include a circular lever element 15*c* having the external surface 15*f*, and a lever element 15L where a force is applied upon rotating the rotating lever 15.

As shown in FIG. 3A, the holder-side protrusions 4*a* on the internal surface 4*f* of the rear bearing-holder 4 are not in contact with the lever-side protrusions 15*a* on the external surface 15*f* of the rotating lever 15 when the rear-end projection 1*d* engages with the rear bearing 5. When the rotating lever 15 rotates from the position as shown in FIG. 3A in counterclockwise direction (a direction indicated by an arrow A in FIG. 3C), the holder-side protrusions 4*a* on the internal surface 4*f* of the rear bearing-holder 4 mounts on the lever-side protrusions 15*a* on the external surface 15*f* of the rotating lever 15, as shown in FIG. 3C. When the protrusions mount on each other, the lever-side protrusions 15*a* on the external surface 15*f* of the rotating lever 15 are pressed against the holder-side protrusions 4*a* on the internal surface 4*f* of the rear bearing-holder 4. However, because the rear bearing-holder 4 with the holder-side protrusions 4*a* is fixed, the rotating lever 15 having the lever-side protrusions 15*a* is pressed to the front side (in a direction indicated by an arrow F in FIG. 3D). Because the two holder-side protrusions 4*a* mount on the two lever-side protrusions 15*a* simultaneously as shown in FIGS. 3A to 3D, a force is transferred more easily in the direction approximately parallel to the rotation axis of the photoconductor 1, compared to those having a case that the single protrusion 4*a* and the single protrusion 15*a* are provided. Because the pressing force is applied to the rotating lever 15 in a direction parallel to the rotation axis of the photoconductor 1, and away from the rear panel 2*a*, the rotating lever 15 is displaced in parallel to a normal direction for removing the photoconductor 1, toward the front side. The rotating lever 15 moves together with the photoconductor 1. Therefore, when the rotating lever 15 is displaced in parallel to the front side from the position as shown in FIG. 2, the photoconductor 1 is also displaced in parallel toward the front side.

In this manner, the rotating lever 15, having the lever-side protrusions 15*a* and moving with the photoconductor 1 toward the front side, and the rear bearing-holder 4, having the holder-side protrusions 4*a*, form a mechanism that converts the rotation of the rotating lever 15 around the rotation axis to a force in the normal direction for removing a rotary body, that is, the photoconductor 1.

Because the photoconductor 1 can be displaced in the normal direction for removing the photoconductor 1 by rotating the rotating lever 15, the rear-end projection 1*d* can be disengaged from the rear bearing 5 without getting seized, with an easy operation.

To remove the photoconductor 1 that is in the position as shown in FIG. 2, the operator removes the knob 14 screwed into the drum shaft 9, takes out the front bearing-holder 6, and pulls out the photoconductor unit 2 from the main frame 3. The operator sequentially rotates the rotating lever 15 attached to the rear-side of the photoconductor 1. As explained above in reference to FIGS. 3A to 3D, along the way the rotating lever 15 is rotated, the lever-side protrusions 15*a* on the rotating lever 15 mount on the holder-side protrusions 4*a* on the rear bearing-holder 4. By protrusions mounting on each other to push the rotating lever 15 to the front side, the rotating lever 15 is pushed against the rear panel 1*b* to carry the photoconductor 1 in the thrust direction and to disengage the rear-end projection 1*d* from the rear bearing 5. Finally, the operator lifts up the photoconductor 1 and takes it out from the photoconductor unit 2.

The holder-side protrusions 4*a* and the lever-side protrusions 15*a* are preferably arranged so that each angle between a line on which one of the holder-side protrusions 4*a* and the rotation axis fall and another line on which one of the lever-side protrusions 15*a* with which the holder-side protrusion 4*a* overlaps and the rotation axis fall is equal, and the distance between each protrusion and the rotation axis is equal (protrusions are arranged on the single circumference). In other words, each protrusion is located on the same circumference with an equal interval. If the holder-side protrusions 4*a* and the lever-side protrusions 15*a* are arranged in this manner, when the holder-side protrusions 4*a* and the lever-side protrusions 15*a* mounts on each other to push the photoconductor 1, the force is distributed equally over the photoconductor 1 so that photoconductor 1 slides in the parallel to the rotation axis thereof. Therefore, the photoconductor 1 can be displaced in the normal direction for removal, reliably preventing the rear-end projection 1*d* from getting caught in the engaged area of the rear bearing 5.

In this manner, the photoconductor 1, as a rotary body, can be removed successfully from the rear panel 2*a* of the photoconductor unit 2, which is the supporting member on the image forming apparatus. Furthermore, because the operator can disengage the rear-end projection 1*d* from the rear bearing 5 by rotating the rotating lever 15, the operator is better prevented from mistakenly touching the surface of the photoconductor 1 upon sliding the photoconductor 1 in the thrust direction. In this manner, troubles, such as image being defective, due to the surface of the photoconductor 1 being touched upon removal can be avoided.

In the embodiment, the rotatable member that rotates around the rotation axis of the photoconductor 1 includes the rotating lever 15 having the lever element 15L and the circular lever element 15*c* integrated with each other. However, such a rotatable member can alternatively include a lever element that can be attached to the rotatable member upon removing the photoconductor 1 to rotate the rotatable member about the axis of the photoconductor 1. The rotatable member can not only the lever element, but also has any other structures to rotate the rotatable member around the rotation axis of the photoconductor 1 upon removing the photoconductor 1. In the embodiment, the rotatable member included the rotating lever 15 integrated with the lever element 15L and the circular lever element 15*c*. This structure allows the rotatable member to be rotated around the rotation axis easily, by way of a simple lever structure.

The protrusions in the embodiment, the holder-side protrusions 4*a* and the lever-side protrusions 15*a*, are hemispherical in shape, as shown in FIGS. 3A to 3D. Because the hemispherical shapes do not have any corners, the rotating lever 15 can rotate without the protrusions getting stuck even when sides of the holder-side protrusions 4*a* and the lever-side protrusions 15*a* mount on each other. Therefore, even if the rotating lever 15 is further rotated, the apex of each protrusion comes in contact with a corresponding protrusion as shown in FIGS. 3C and 3D. However, the shape of the protrusions is not limited to the hemisphere as shown in FIG. 3A to 3D, but the protrusions can be of any shape, such as a sloped shape with rotating circumference thereof is sloped, as long as the protrusions do not get stuck when side thereof mounts on each other, and the rotating lever 15 can be further rotated.

Moreover, each of the numbers of the holder-side protrusions 4*a* and the lever-side protrusions 15*a* is two. However, if two pairs of the protrusions overlap at each time of disengagement, any number of protrusions can be provided For example, the rotating lever 15 can also have two symmetrical lever-side protrusions 15*a* with respect to the rotation axis on the external surface 15*f* thereof, in the same way as shown in FIGS. 3A to 3D, and the rear bearing-holder 4 can have four folder-side protrusions 4*a* on the internal surface 4*f* arranged so that the lines connecting each protrusion 4*a* and the rotation axis enclose an angle of 90° with one another. Alternatively, the rotating lever 15 and the rear bearing-holder 4 can have the same number, for example three or larger, of the protrusions on the external surface 15*f* and the internal surface 4*f* thereof, and all protrusions overlap with a corresponding one of the protrusions at each time of disengagement.

Furthermore, the rear bearing-holder 4 is faced against the external surface 15*f* of the rotating lever 15, which is a rotating member located at the end of the roller body, having the lever-side protrusions 15*a* as the rotating-body-side protrusions. However, such a facing member is not limited to the bearing-holding member. Such a facing member can have any structure as long as it is fixed on the rear panel 2*a* of the photoconductor unit 2 and can tolerate being rubbed against the external surface 15*f* of the rotating lever 15 having the lever-side protrusions 15*a*, and pressing force applied from the rotating lever 15 to disengage the rear-end projection 1*d* of the photoconductor 1 from the rear bearing 5.

Moreover, the photoconductor 1 as a rotary body is attached with the rotating lever 15, a member rotatable about the axis thereof to form a mechanism to convert the rotation of the rotatable member about the axis thereof to the separating force that displace the rotary body away from the apparatus-side supporting member, in parallel with the rotation axis of the photoconductor 1. However, the structure according to the embodiment is not intended to be limited to the above. For example, the rotatable member can be provided on the apparatus itself, such as on the rear panel 2*a*. In such an arrangement, a facing member is provided on the photoconductor 1, facing the rotatable member provided on the rear panel 2*a* of the photoconductor unit 2. By providing protrusions on the facing surfaces of the rotatable member and the facing member, respectively, the rotation of the rotatable member around the rotation axis can be converted to the force separating the rotary body from the apparatus-side supporting member, in parallel with the rotation axis thereof.

Furthermore, the photoconductor unit 2 is removed from the main frame 3 after the front bearing-holder 6, having the front bearing 7 supporting the front-end projection 1*e* of the photoconductor 1, is removed. However, the structure according of the present invention is not limited to the one disclosed above, with the photoconductor unit 2 being removed separately from the front bearing-holder 6. For example, the front bearing-holder 6 can also be integrated with the photoconductor unit 2 to be removed together from the main frame 3. In this example, the front-end projection 1*e* is disengaged from the front bearing-holder 6 after the photoconductor unit 2 is removed from the main frame 3.

Figure 4:
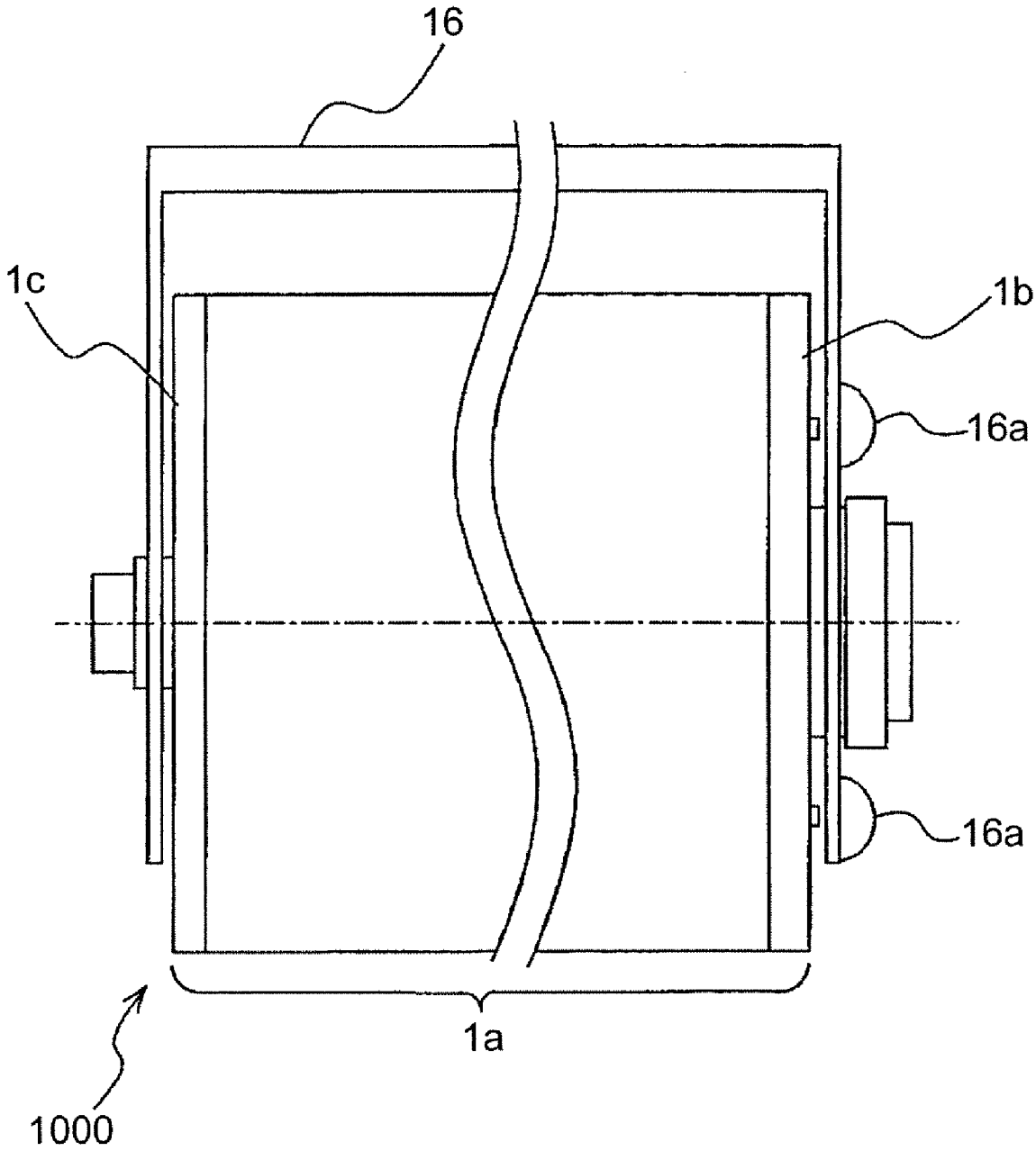
FIG. 4 is a schematic diagram of a photoconductor according to a modification of the embodiment.

FIG. 4 is a schematic diagram of a photoconductor 1000 according to a first modification of the embodiment. The photoconductor 1000 is housed in the photoconductor unit 2. As shown in FIG. 4, the photoconductor 1000 includes a handle element 16 instead of the lever element 15L of the rotating lever 15 shown in FIG. 2. The handle element 16 is formed based on the lever element 15L extending to the front side. The handle element 16 is engaged into the engaging member integrated with the front panel 1*c* and the rear panel 1*b* of the photoconductor 1, which are the panels located at both ends of the roller body 1*a* of the photoconductor 1, and used as a handle upon mounting or removing the photoconductor 1. As shown in FIG. 4, the handle element 16 has handle-side protrusions 16*a* that has the same function as the lever-side protrusions 15*a* of the above embodiment. The handle element 16 is useful not only in disengaging the rear-end projection 1*d* from the rear bearing 5, but also in removing the photoconductor 1 from the photoconductor unit 2, preventing the operator from touching the photoconductor 1 directly. As a result, risks of the photoconductor 1 being smudged or damaged can be reduced.

In the above embodiment, the lever-side protrusions 15*a* are formed on the external surface 15*f* of the rotating lever 15, and the holder-side protrusions 4*a* are formed on the internal surface 4*f* of the rear bearing-holder 4. The rotation of the rotating lever 15 causes each protrusion to mount on each other, generating the pressing force to move the rotating lever 15 in the thrust direction away from the rear panel 2*a* of the photoconductor unit 2, disengaging the rear-end projection 1*d* of the photoconductor 1 from the rear bearing 5.

However, the structure of the present invention is not limited to protrusions formed on the external surface 15*f* of the rotating lever 15 and the internal surface 4*f* of the rear bearing-holder 4.

In a second modification of the above embodiment described in the following section, the external surface 15*f* of the rotating lever 15 has the protrusions, and an internal surface 40*f* of a rear bearing-holder 40 has recessions.

Figure 5A:
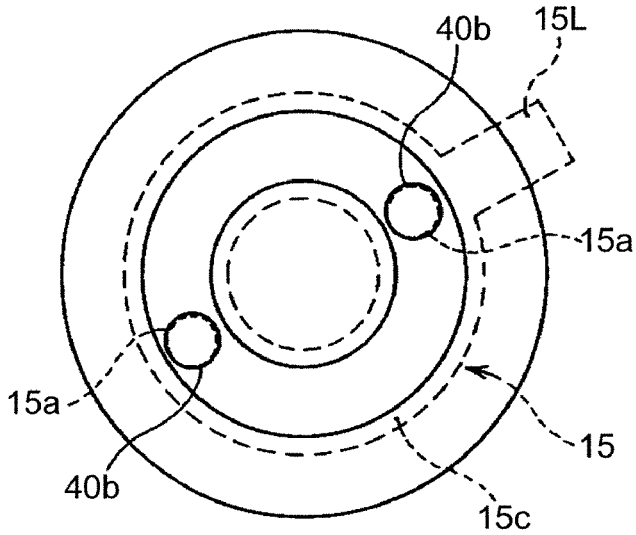
FIG. 5A is a top view of a rotating lever and a rear bearing-holder shown in FIG. 4 in an engaged state.
Figure 5B:
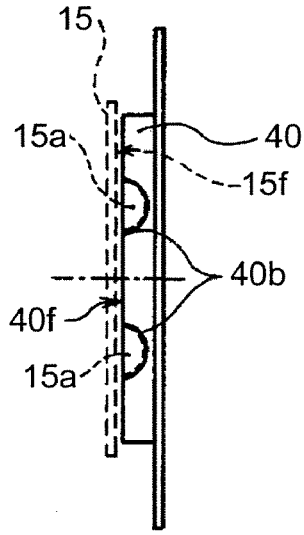
FIG. 5B is a side view of the rotating lever and the rear bearing-holder shown in FIG. 5A.
Figure 5C:
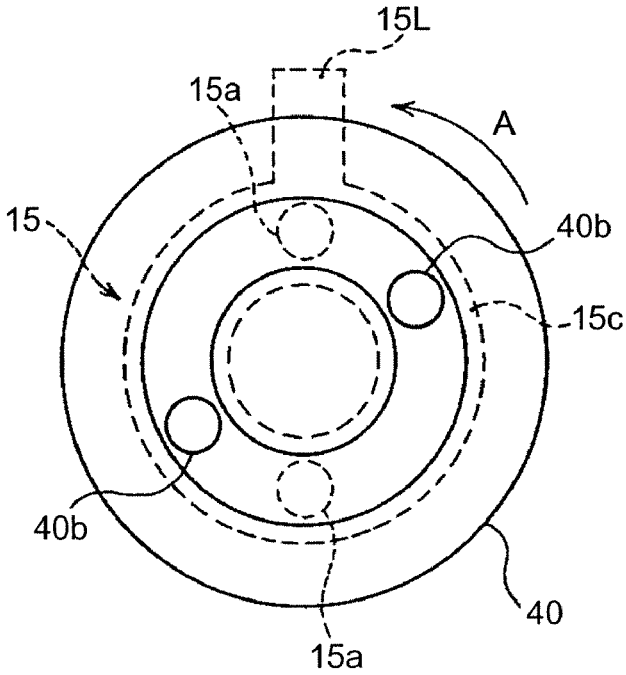
FIG. 5C is a top view of the rotating lever and the rear bearing-holder shown in FIG. 2 in a disengaged state.
Figure 5D:
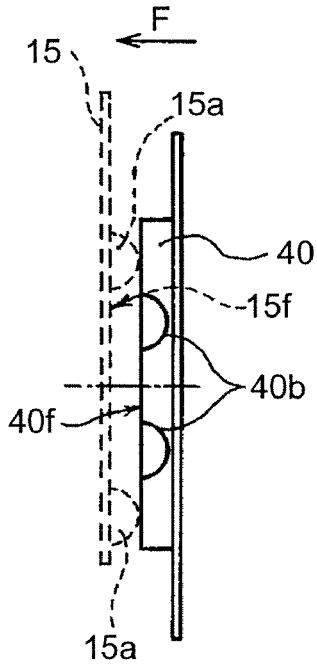
FIG. 5D is a side view of the rotating lever and the rear bearing-holder shown in FIG. 5C.
Figure 6A:
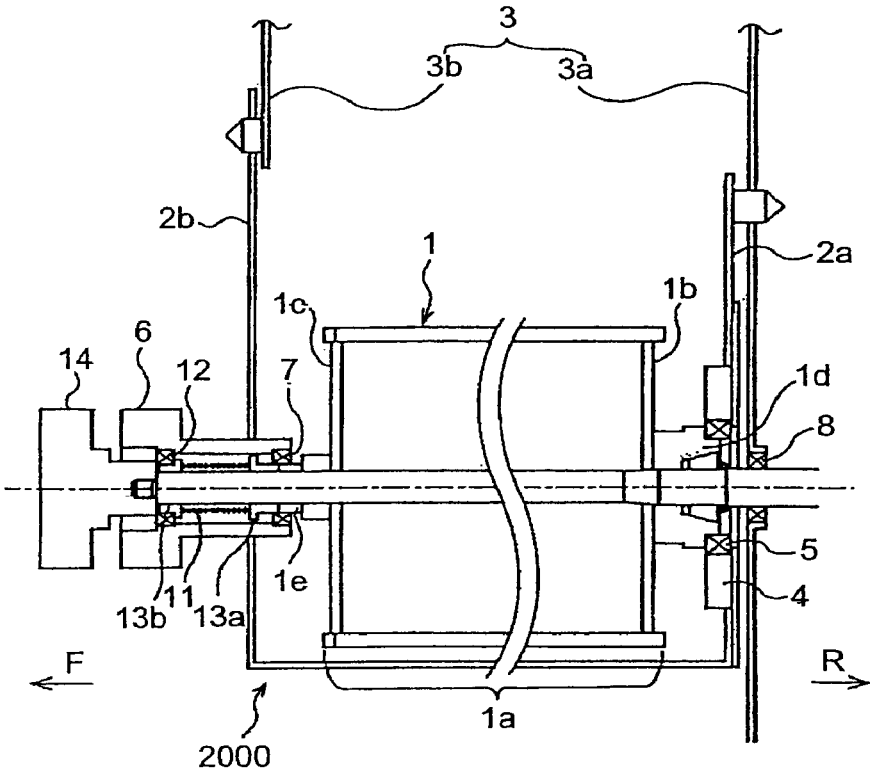
FIG.6A RELATED ART
FIG. 6A is a schematic diagram of a conventional photoconductor unit when attached to a main frame of the image forming apparatus.
Figure 6B:
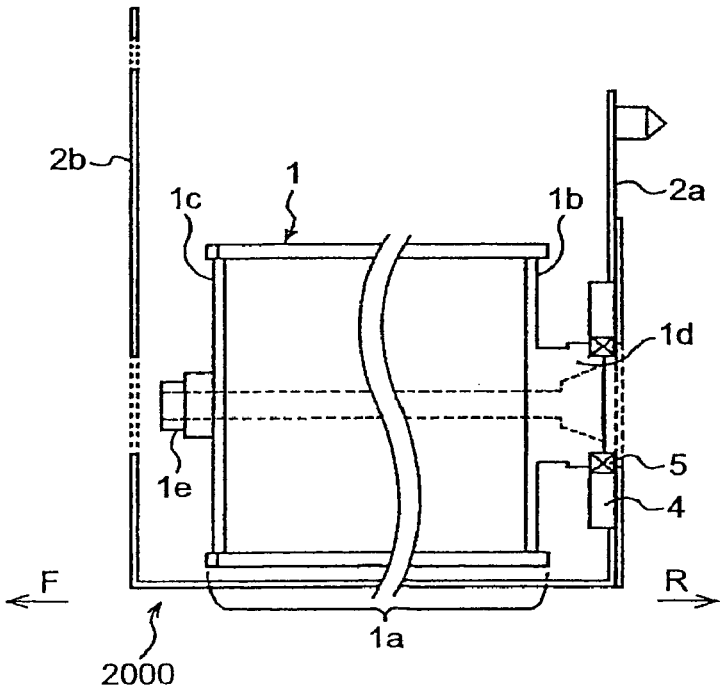
FIG.6B RELATED ART
FIG. 6B is a schematic diagram of the conventional photoconductor unit shown in FIG. 6B when detached from the main frame.

FIGS. 5A to 5D are schematic diagrams of the external surface 15*f* having protrusions 15*a* and the internal surface 40*f* having recessions 40*b* according to the second modification. FIGS. 5A and 5B are schematic diagrams showing the positions of the holder-side recessions 40*b* and the lever-side protrusions 15*a* when the rear-end projection 1*d* and the rear bearing 5 are in engagement. FIGS. 5C and 5D are schematic diagrams showing the positions of the holder-side recessions 40*b* and the lever-side protrusions 15*a* when the rear-end projection 1*d* and the rear bearing 5 are disengaged.

FIGS. 5A and 5C are top views of the holder-side recessions 40*b* and the lever-side protrusions 15*a* viewing in the direction of the rotation axis of the photoconductor 1. FIGS. 5B and 5D are side view. As shown in FIGS. 5A to 5D, solid lines indicate the shapes of the rear bearing-holder 40, and dotted lines indicate the shapes of the rotating lever 15.

As shown in FIGS. 5A and 5B, the lever-side protrusions 15*a* on the external surface 15*f* of the rotating lever 15 face to and fit into the holder-side recessions 40*b* on the internal surface 40*f* of the rear bearing-holder 40, when the rear-end projection 1*d* of the photoconductor 1 and the rear bearing 5 are in engagement. In this position, the internal surface 40*f* of the rear bearing-holder 40 is a close proximity of the external surface 15*f* of the rotating lever 15 as shown in FIG. 5B. When the rotating lever 15 rotates in a counter-clockwise direction (the direction shown with an arrow A in FIG. 5C) from the position shown in FIG. 5A, the holder-side recessions 40*b* on the internal surface 40*f* of the rear bearing-holder 40 are dislocated from the lever-side protrusions 15*a* on the external surface 15*f* of the rotating lever 15, and the lever-side protrusions 15*a* run on the flat area of the internal surface 40*f* of the rear bearing-holder 40 as shown in FIG. 5D. By the lever-side protrusions 15*a*, which have been fit into the holder-side recessions 40*b*, mounting on the flat area, the lever-side protrusions 15*a* is pushed against the flat area. Because the rear bearing-holder 40 having the internal surface 40*f* is fixed, the rotating lever 15 having the lever-side protrusions 15*a* moves toward the front side (in the direction shown with an arrow F in FIG. 5D). Alternatively, the protrusions can be formed on the internal surface 40*f* of the rear bearing-holder 40, and the recessions on the external surface 15*f* of the rotating lever 15.

In the above embodiment, the first and the second modifications thereof, the rotary body is explained to be a photoconductor. However, the rotary body can be any rotary body as long as the rotary body is supported by engaging a part thereof to a supporting member of the apparatus itself, and the part of the rotary body is disengaged from the supporting member of the apparatus itself by sliding the rotary body along the rotation axis thereof.

The image forming apparatus according to the above embodiment has the rotating lever 15 and the mechanism that converts the rotation of the rotating lever 15 around the rotation axis thereof to the force to facilitate removing the photoconductor unit 2 in a normal direction. Therefore, the photoconductor 1 can be displaced along the normal direction that the photoconductor is removed with an easy operation. This structure allows the rear bearing 5 to be disengaged from the rear-end projection 1*d* without getting seized. Because the rear bearing 5 and the rear-end projection 1*d* are prevented from being seized, the photoconductor 1 is advantageously removed from the apparatus itself smoothly.

Moreover, because the rear bearing-holder 4, which is an apparatus-side facing member that faces the external surface 15*f* of the rotating lever 15, located at the opposite side of to the normal direction for removing the photoconductor 1, is fixed on the rear panel 2*a* of the photoconductor unit 2, and the rotating lever 15 is rotated while the surface structure of the external surface 15*f* of the rotating lever 15 is in contact with that of the internal surface 4*f* of the rear bearing-holder 4 so as to displace the rotating lever 15 away from the rear bearing-holder 4, the photoconductor 1 can be displaced with the rotating lever 15 in the same direction. In this manner, the rotation of the rotating lever 15 around the rotation axis thereof is converted to the force having a direction along the normal direction for removing photoconductor 1.

Furthermore, the external surface 15*f* of the rotating lever 15 has the two lever-side protrusions 15*a*, and the internal surface 4*f* of the rear bearing-holder 4 has the two holder-side protrusions 4*a* in positions so as to face the lever-side protrusions 15*a* when the rotating lever 15 is rotated around the rotation axis thereof. When a pair of the lever-side protrusion 15*a* and the holder-side protrusion 4*a* are faced in contact, the remaining pairs of the lever-side protrusion 15*a* and the holder-side protrusions 4*a* also face in contact. With such surface structure, by rotating the rotating lever 15 around the rotation axis thereof, a force is generated to separate the rotating lever 15 away from the rear bearing-holder 4.

Moreover, by distributing the lever-side protrusions 15*a* and the holder-side protrusions 4*a* evenly on the same circumference around the rotation axis of photoconductor 1, the photoconductor 1 can be slid in a direction parallel to the rotation axis thereof by holder-side protrusions 4*a* and the lever-side protrusions 15*a* pushing each other, with the force applied evenly across the photoconductor 1. Therefore, the rear-end projection 1*d* of the photoconductor 1 can be prevented from getting seized in the rear bearing 5 upon disengagement thereof.

Furthermore, the photoconductor 1 has the rotating lever 15 between the roller body 1*a* and the rear-end projection 1*d* thereof. When the rotating lever 15 moves toward the front side, that is, in the normal direction of removing the photoconductor 1, from the position the rear-end projection 1*d* of the photoconductor 1 engages with the rear bearing 5, the rotating lever 15 pushes the rear panel 1*b* of the photoconductor 1. Therefore, the photoconductor 1 moves together with the rotating lever 15 in the same direction.

Moreover, if the rotary body is a photoconductor 1, the surface of the photoconductor 1 can be prevented from being touched mistakenly upon moving the photoconductor 1 along the normal direction for removal thereof, because the rear-end projection 1*d* can be disengaged from the rear bearing 5 by rotating the rotating lever 15. In this manner, troubles, such as image being defective, due to the surface of the photoconductor 1 being touched upon removal can be avoided.

Furthermore, the rear-end projection 1*d*, as an engaging member on the rotary body, engages into the rear bearing 5, as an apparatus-side engaging member supported on the rear bearing-holder 4 fixed on the rear panel 2*a* of the photoconductor unit 2. Therefore, the bearing is held more stably by the bearing holder, compared with a structure where one end of the rotation axis of the photoconductor 1 is provided with bearing holding member that is engaged with the bearing holding member fixed on the rear panel 2*a* of the photoconductor unit 2. Therefore, the axis of the photoconductor 1 can be prevented from being shaken upon rotation thereof.

Moreover, the external surface 15*f* of the rotating lever 15 faces the rear bearing-holder 4 located on the internal surface 4*f* circumferentially outside of the rear bearing 5, facing the roller body 1*a*. Because the rear bearing-holder 4, generally the bearing holding member, holds the rear bearing 5, generally the bearing member, the rear bearing-holder 4 is often made of highly strong materials such as metal or resin of high strength. Because the rear bearing-holder 4 is made of a highly strong material, the rear bearing-holder 4 is strong against deformation due to being rubbed against the external surface 15*f* with the lever-side protrusions 15*a*, or being applied with pressure from the external surface 15*f* upon disengagement. Therefore, by using the internal surface 4*f* of the rear bearing-holder 4 as the facing surface, it is not necessary to provide another facing surface made of a highly strong material, to prevent deformation due to the rubbing or the pressure. As a result, the cost can be reduced.

Furthermore, the rotating lever 15 includes the circular lever element 15*c*, which forms the external surface 15*f* having lever-side protrusions 15*a*, and the lever element 15L, which is applied with a force upon rotating the rotating lever 15. Therefore, the operator can disengage the rear-end projection 1*d* of the photoconductor 1 from the rear bearing 5 with a simple operation by holding the lever element 15L and rotating the rotating lever 15. Therefore, the operation does not require any skill in the operator, and anybody can easily perform the operation.

Moreover, the rotating lever 15 can be replaced with the handle element 16, with the lever element 15L functioning as a handle for removing the photoconductor 1 from the rear panel 2*a* of the photoconductor unit 2 and further from the photoconductor unit 2. In this manner, the photoconductor 1 can be removed more easily, by using the lever member for rotating the rotatable element around the rotation axis thereof as a handle for removing the photoconductor 1.

Furthermore, the photoconductor 1, that is, a rotary body, is housed in the photoconductor unit 2, and the apparatus-side supporting member is provided on the rear panel 2*a*, that is, a frame that forms the photoconductor unit 2. Therefore, the present invention can be applied to the structure having the photoconductor unit 2.

Moreover, the photoconductor unit 2 can be pulled out in the axial direction of the photoconductor 1 with respect to the main frame 3 of the copy machine. Therefore, the photoconductor 1 can be easily removed from the photoconductor unit 2 while the photoconductor unit 2 is pulled out.

According to an embodiment of the present invention, it is possible to prevent the engagement between the apparatus-side supporting member and the rotary body from getting seized. Therefore, the rotary body can be advantageously removed from the image forming apparatus smoothly.

Moreover, the rotary body can be displaced in a normal direction for removal by rotating a rotatable member around the rotation axis of the rotary body. In this manner, the rotary body can be disengaged from the supporting member on the apparatus itself, without getting seized by the supporting member.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

a rotary body;

a supporting member that detachably and rotatably supports a portion of the rotary body, the rotary body being detachable from the supporting member when moved in a detachment direction;

a rotatable member that rotates around a rotation axis of the rotary body, rotation of the rotatable member being independent of rotation of the rotary body; and a force-converting mechanism that converts a rotation force generated by the rotation of the rotatable member into a force whereby the rotary body moves in the detachment direction thereby detaching from the supporting member.

2. The image forming apparatus according to claim 1, further comprising an apparatus-side member in a direction opposite to the detachment direction, the apparatus-side member having a fixed positional relation with the rotatable member, the apparatus-side member having a first surface facing toward the rotatable member, the rotatable member having a second surface facing toward the first surface, wherein when the rotatable member is rotated in a state that the first surface is in contact with the second surface, the force-converting mechanism converts the rotation force generated by the rotation of the rotatable member into the force thereby moving the rotatable member in the detachment direction thereby the first surface separating from the second surface whereby the rotary body moves in the detachment direction thereby detaching from the supporting member.

3. The image forming apparatus according to claim 2, wherein the first surface has a plurality of first protrusions, the second surface has a plurality of second protrusions, at a first relative position of the first surface and the second surface the first protrusions are positioned between the second protrusions, and when the rotatable member is rotated, at a second relative position of the first surface and the second surface the first protrusions ride on the second protrusions whereby the rotatable member moves in the detachment direction thereby separating the first surface from the second surface.

4. The image forming apparatus according to claim 3, wherein the first protrusions are arranged at a regular interval on a first circle on the first surface, the second protrusions are arranged at a regular interval on a second circle on the second surface, and radius of the first circle is same as radius of the second circle.

5. The image forming apparatus according to claim 2, wherein when the rotatable member moves in the detachment direction, the rotatable member abuts with the rotary body whereby the rotary body moves in the detachment direction thereby detaching from the supporting member.

6. The image forming apparatus according to claim 2, wherein the supporting member includes a fixed member; and a bearing member that is immovably fixed to the fixed member and that detachably and rotatably supports the rotation axis of the rotary body.

7. The image forming apparatus according to claim 6, wherein the rotary body has the rotatable member at an apparatus-side end of the rotation axis thereof, the second surface of the rotatable member faces the fixed member, and a surface of the fixed member facing the second surface is the first surface.

8. The image forming apparatus according to claim 2, wherein the rotatable member further includes a lever for use in rotating the rotatable member around the rotation axis.

9. The image forming apparatus according to claim 8, wherein the lever functions as a handle at which the rotary body is held when pulled out.

10. The image forming apparatus according to claim 1, wherein the rotary body is a photoconductor.

11. The image forming apparatus according to claim 1, further comprising a housing unit that houses the rotary body, wherein the supporting member is attached to a frame of the housing unit.

12. The image forming apparatus according to claim 11, wherein the housing unit is movable along the rotation axis away from the image forming apparatus.

* * * * *